United States Patent [19]

Abendroth et al.

[11] Patent Number: 5,007,342

[45] Date of Patent: Apr. 16, 1991

[54] AIR CUSHION DRUM OR SHEET-FED PRINTING PRESSES

[75] Inventors: Paul Abendroth, Offenbach am Main; Harry Brandes, Obertshausen; Rudolf Raab, Hanau, all of Fed. Rep. of Germany

[73] Assignee: Man Roland Druckmaschinen AG, Fed. Rep. of Germany

[21] Appl. No.: 391,165

[22] Filed: Aug. 9, 1989

[51] Int. Cl.[5] ..... B41F 13/08

[52] U.S. Cl. ..... 101/420; 101/416.1

[58] Field of Search ..... 101/420, 421, 416.1, 101/417, 418, 419, 422, 424.1, 424.2, 487, 488; 226/7, 97, 196; 34/115

[56] References Cited

U.S. PATENT DOCUMENTS

| | | | |
|---|---|---|---|
| 3,542,358 | 11/1970 | Schuhmann | 101/420 |
| 4,297,794 | 11/1981 | Luthi | 34/115 |
| 4,506,841 | 4/1985 | Hood | 226/97 |
| 4,552,069 | 11/1985 | Jahn | 101/420 |
| 4,688,784 | 8/1987 | Wirz | 101/420 |
| 4,824,002 | 4/1989 | Ford et al. | 226/97 |
| 4,843,731 | 7/1989 | Vits | 226/97 |
| 4,919,319 | 4/1990 | Ford et al. | 226/97 |

FOREIGN PATENT DOCUMENTS

| | | | |
|---|---|---|---|
| 32875 | 7/1981 | European Pat. Off. | 226/97 |
| PS1561043 | 3/1967 | Fed. Rep. of Germany . | |
| PS3347886 | 8/1983 | Fed. Rep. of Germany . | |

*Primary Examiner*—Edgar S. Burr
*Assistant Examiner*—Joseph R. Keating
*Attorney, Agent, or Firm*—Leydig, Voit & Mayer

[57] ABSTRACT

An air cushion drum for a sheet-fed printing press is formed with an internal body and an outer casing defining a cavity inside the drum through which air streams are supplied to issue from orifices in the drum casing and force the sheets away therefrom. To reduce airflow noise a sound-absorbent layer which has radial ducts is disposed in the cavity and forms therein an air-permeable partition which is equidistant from the drum casing. In the preferred embodiment, the sound-absorbent layer is supported by a lattice formed with droplet shaped members which further reduce air flow resistance and the sound-absorbent layer which may be formed of felt or foam is supported on the lattice by an outer stabilizing layer of plastic material.

9 Claims, 2 Drawing Sheets

AIR CUSHION DRUM OR SHEET-FED PRINTING PRESSES

FIELD OF THE INVENTION

The present invention relates generally to an air cushion drum for sheet-fed printing presses, and more particularly concerns such a drum in which air streams are supplied through a cavity inside the drum and the air issues from orifices in the drum casing to force the sheets away therefrom.

BACKGROUND OF THE INVENTION

One prior art type of basic air cushion drum is known from DE-PS 1,561,043. The casing of this prior art drum is made of a porous material so that the air issues radially to atmosphere from a large number of pores uniformly distributed over drum length and forms on the drum periphery a thin air cushion inhibiting contact between the printed sheets and the drum and thus preventing ink set-off. As also disclosed, this known drum is double-walled and the between-walls cavity or space is divided by ribs into discrete chambers which extend parallel to the drum axis and which by means of control elements are supplied consecutively with air as the drum rotates. Although drums of this kind have proved satisfactory for air cushioning purposes, the noise caused by the airstreams is a serious disadvantage.

OBJECTS AND SUMMARY OF THE INVENTION

It is the primary aim of the present invention to provide an air cushion drum of the kind hereinbefore set out with reduced airflow noise. According to the invention, therefore, a sound-absorbent layer is disposed opposite the air exit orifices in the drum casing. Surprisingly, it has been found that the provision of a sound-absorbent layer in the drum cavity through which the air is supplied according to the present invention reduced airflow noise considerably.

According to another general object and feature of the invention, and to reduce noise even more effectively, the sound-absorbent layer is effective in the cavity as an air-permeable partition which is substantially equidistant from the drum casing and through which air passes to the inside of the drum casing. This arrangement has the further advantage that pressure is distributed uniformly over the whole of drum width and a uniform air cushion arises below the sheet.

It is a more specific object, according to the invention, that the sound-absorbent layer can be supported by a lattice and, to reduce flow resistance, the lattice members can have a cross-section which is droplet-shaped in the flow direction. It is yet another feature and object of the invention and to ensure that the flow resistance of the sound-absorbent layer is very low, that the sound-absorbent layer can have a large number of radial ducts which have been found to further improve sound adsorption.

In keeping with the invention, the sound-absorbent layer can be sheathed or covered by a dimensionally stable layer, preferably of plastic material which receives the forces produced by the airflow and the rotation of the drum and secures the sound-absorbent layer to the lattice. According to a preferred embodiment of the invention, the sound-absorbent layer is made of felt.

The foregoing features of the present invention have proved to be very effective in association with a composite drum casing consisting of a number of air-permeable layers. Preferably in this case, the drum casing comprises, in sequential order from the inside towards the outside, a support screen, a cardboard filter and a cover screen.

These and other features and advantages of the invention will be more readily apparent upon reading the following description of a preferred exemplified embodiment of the invention and upon reference to the accompanying drawings wherein:

Figure 1:
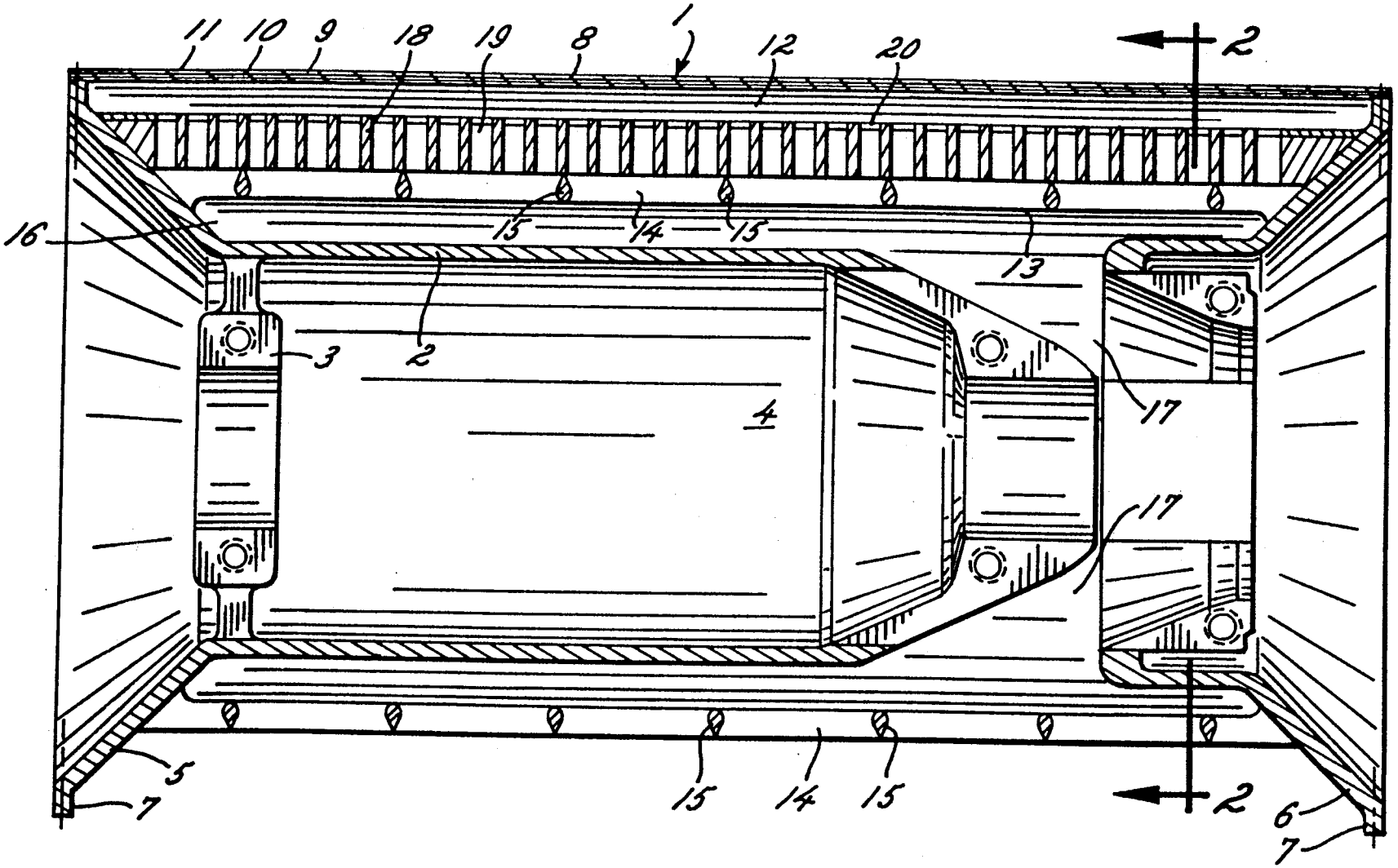
FIG. 1 is a longitudinal cross-section through an air cushion drum according to the present invention.
Figure 2:
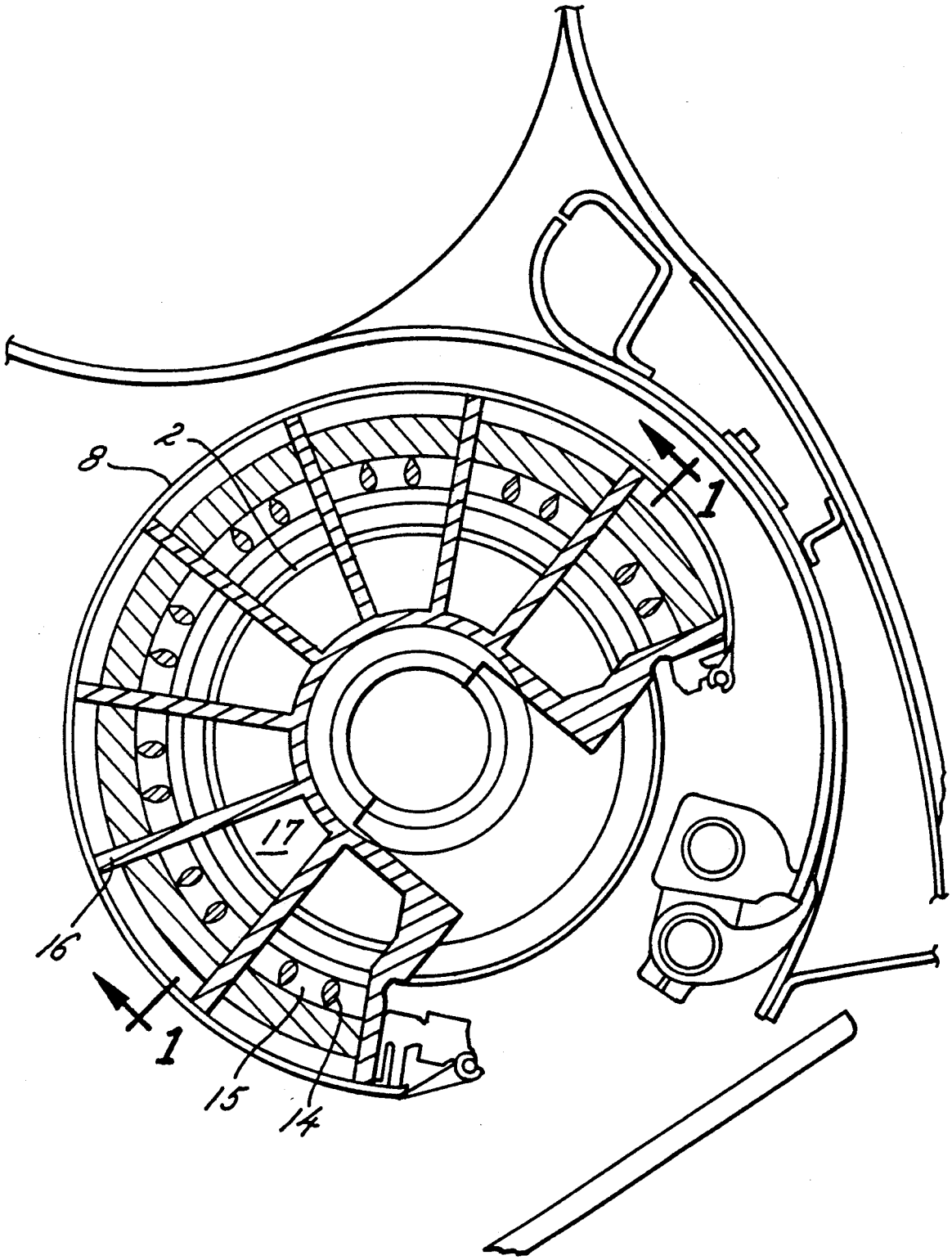
FIG. 2 is a transverse cross-section of the drum substantially as seen in the direction of line 2—2 in FIG. 1.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, an air cushion drum 1 is illustrated which comprises an internal substantially cylindrical body 2 adapted to be secured to a continuous shaft by way of split flange rings 3, 4. At both ends the body 2 has end walls 5, 6 which widen outwardly conically and which each merge into a radial annular collar 7. Secured to the collars 7 is a drum casing 8 comprising three air-permeable layers disposed one on another, viz. an inner support or backing filter 9, a central cardboard or a filter 10 and an outer cover filter 11.

Disposed in cavity 12 between the casing 8 and the body 2 concentrically thereof is a lattice 13 including longitudinal members 14 which extend parallel to the drum axis and circumferential members 15 which extend in the peripheral direction. Preferably, the lattice members 14, 15 have a cross-section which is droplet-shaped in the flow direction to further reduce air flow resistance. Radial walls or ribs or the like 16 which are parallel to the drum axis and which extend from the body 2 to the casing 8 subdivide the cavity 12 into discrete chambers 17 which as the drum 1 rotates are connected consecutively by way of feed ducts to an air supply means.

In accordance with the invention, a layer 18 of a sound-absorbent material, for example, a foam substance or a fiber material, having a large number of radial ducts 19 for the passage of the air is secured on the lattice 13. Preferably, the sound-absorbent layer 18 is covered on its outside surface by a dimensionally stable layer 20 which retains the layer 18 on the lattice 13 and receives the radially outwardly directed flow and centrifugal forces. As illustrated in the drawing, the radial ducts 19 also extend through the layer 20 and the outside surface of the layer 20 is at a radial distance from the casing 8 so that an air distribution space is provided and the air has free access to the entire inside surface of the casing 8. This spacing also enhances the sound-damping effect of the sound-absorbent layer 18.

Pursuant to the invention, the sound-absorbent layer can be made of fiber substances or a foam substance. Preferably, a felt is used since felt provides substantial sound-damping, can readily be processed and greatly reduces the entrainment of fibers by the air.

From the foregoing, it will be appreciated that the provision of the sound-absorbent layer 18 leads to substantial damping of flow noise in the drum described. Thus, the sound-absorbent layer 18 has a sound-damping effect on both its inside and its outside. The sound-absorbent layer 18 also helps to make pressure distribution uniform on the inside of the casing 8 by retarding the air which enters laterally through the chambers 17 at a relatively high flow velocity from the supply means and by deflecting such air by way of the ducts 19 toward the casing 8 at an even pressure.

We claim as our invention:

1. An air cushion drum for supporting sheets in sheet-fed printing presses, said drum comprising in combination, an inner drum body and an outer drum casing, said outer drum casing having a plurality of orifices therein, said body and said casing defining a cavity therebetween, means for supplying air streams into the drum cavity so that air issuing from said orifices in the drum casing forces the sheets away therefrom, and a sound-absorbent layer disposed in said cavity between said inner drum body and said outer drum casing opposite said orifices in said casing, said sound-absorbent layer being disposed concentrically in said cavity and spaced radially inwardly from said outer drum casing so as to define an air distribution space therebetween, and said sound-absorbent layer forming an air-permeable partition through which said air streams flow from said supply means into said air distribution space and then out through said orifices in said outer drum casing.

2. A drum according to claim 1, characterized in that the inner side of the sound absorbent layer is supported by a lattice having longitudinal and circumferential members.

3. A drum according to claim 2, characterized in that the lattice members have a cross-section which is droplet-shaped in the flow direction.

4. A drum according to claim 3, characterized in that the sound-absorbent layer is covered on the side remote from the lattice by a dimensionally stable layer of plastic material.

5. A drum according to claim 1, characterized in that the drum casing is combined from a number of air-permeable layers.

6. A drum according to claim 5, characterized in that the drum casing comprises in order from the inside towards the outside a support screen, a cardboard filter and a cover screen.

7. A drum according to claim 1, characterized in that the sound-absorbent layer has a plurality of radial ducts.

8. A drum according to claim 1, characterized in that the sound-absorbent layer is made of felt.

9. A drum according to claim 1, characterized in that the sound-absorbent layer is made of foam.

* * * * *